US006585588B2

(12) United States Patent
Hartl

(10) Patent No.: US 6,585,588 B2
(45) Date of Patent: Jul. 1, 2003

(54) MULTIPLE PLAY HIGH CARD GAME WITH INSURANCE BET

(75) Inventor: Josef Alexander Hartl, Henderson, NV (US)

(73) Assignee: Shuffle Master, Inc., Eden Prairie, MN (US)

( * ) Notice: Subject to any disclaimer, the term of this patent is extended or adjusted under 35 U.S.C. 154(b) by 0 days.

(21) Appl. No.: 09/922,512

(22) Filed: Aug. 3, 2001

(65) Prior Publication Data

US 2002/0137558 A1 Sep. 26, 2002

Related U.S. Application Data

(60) Provisional application No. 60/278,309, filed on Mar. 22, 2001.

(51) Int. Cl.[7] ..... A63F 13/00
(52) U.S. Cl. ..... 463/16; 273/292
(58) Field of Search ..... 463/9, 12, 13, 463/16–20, 25; 273/292, 293

(56) References Cited

U.S. PATENT DOCUMENTS

| | | | | |
|---|---|---|---|---|
| 4,651,997 A | | 3/1987 | Wood | |
| 5,294,128 A | | 3/1994 | Marquez | |
| 5,324,041 A | | 6/1994 | Boylan et al. | |
| 5,639,092 A | | 6/1997 | Macaisa | |
| 5,713,574 A | | 2/1998 | Hughes | |
| 5,791,989 A | * | 8/1998 | Slinkman | 273/274 |
| 5,810,663 A | | 9/1998 | Bochichio et al. | |
| 6,070,873 A | | 6/2000 | Perkins | |
| 6,220,597 B1 | * | 4/2001 | Scibetta | 273/274 |
| 6,402,148 B1 | * | 6/2002 | Saruwatari | 273/292 |

* cited by examiner

*Primary Examiner*—David A. Scherbel
*Assistant Examiner*—Patrick Buechner
(74) *Attorney, Agent, or Firm*—Mark A. Litman & Assoc. P.A.

(57) ABSTRACT

A player places at least two wagers and an optional insurance wager, the insurance wager providing the player with an immediate payout if the dealer's first card is an Ace or face card. During play, the dealer deals a single card to all players having made a first wager and a card to himself. If the rank of the player's card beats the rank of the dealer's card, the player is paid on this first bet. If the player wins, the dealer deals a second card to the player and one to himself. If the rank of the player's card is higher than that of the dealer's card, he is paid on his second bet. In one form of the game, if the player wins the second bet, in a third wagering round, the player and dealer each receive a card, and if the player's card rank exceeds the dealer's card rank, he is paid on the third bet. The player must win each wagering segment to advance to the next consecutive wagering segment.

58 Claims, 4 Drawing Sheets

MULTIPLE PLAY HIGH CARD GAME WITH INSURANCE BET

RELATED APPLICATIONS

This Application claims priority under 35 U.S.C. 119 (e) from U.S. Provisional Patent Application Serial No. 60/278,309, filed Mar. 22, 2001.

BACKGROUND OF THE INVENTION

1. Field of the Invention

The present invention relates to casino card games, and more specifically, it relates to a card game that allows a player to place three wagers and an optional insurance wager and requires a player to win each consecutive wager before advancing to a subsequent wager.

2. Description of Related Art

Many card games of skill and chance currently exist but suffer numerous drawbacks making them undesirable to certain casino patrons. Some types of card games are difficult to learn and require a large degree of skill to play. Blackjack and Poker are examples of games that require a high degree of skill. Many casino patrons avoid games such as poker because the players perceive that they are at a disadvantage playing against more experienced players. Those inexperienced players who do play these card games often do not enjoy the play of the games, because they do not possess sufficient knowledge of the game to play competitively. Less experienced players are sometimes criticized and intimidated by more experienced players when they deviate from common game strategies. For example, an inexperienced player may draw cards when optimal game strategy dictates otherwise. Such actions will annoy more experienced players, especially when they feel that the card(s) dealt to the inexperienced player would have enhanced his, her or their hand(s).

Other card games are easy to learn, but are less exciting to play. Games such as "Casino War," as described in Boylan, U.S. Pat. No. 5,324,041, provide a lower level of excitement as compared to other casino type card games and may be viewed as undesirable for play by numerous players who prefer to play games requiring a higher level of skill. In the game of Casino War, the dealer deals one card to each player and one card to himself face up. Bets are resolved individually, player by player. If the dealer has the high card, he takes the player's ante bet. If the player's card is the high card, he is paid 1:1 on the ante. In the case of a tie, ½ of the ante is returned to the player, or the player places a second wager. If the second wager is made, both the dealer and player receive an extra card. If the dealer's card beats the player's card, the dealer takes the first and second bet. If the player's card is the high card, he is paid 1:1 on the second bet, and the first bet is a push. If there is another tie, the bets are returned to the player. Although this game has achieved some degree of commercial success, the game lacks the action of other live casino games. It would be desirable to provide a card game that is suitable for casino play, is exciting, provides sufficient action to maintain player interest and is easy to learn.

SUMMARY OF THE INVENTION

The present invention is a variation of a high/low card game. A typical layout design includes six or seven player stations, although the number of stations can vary. According to one method of play, at the beginning of play of the game, each player places at least two, and more typically three wagers, each wager being preferably equal in amount, one wager each on separate betting areas within the player's station. These at least two or at least three wagers are preferably mandatory and not optional or sequentially placed at the beginning of play. The player may place an optional insurance wager. The insurance wager, also called the Ace-Face bet, provides the player with an immediate payout if the dealer's first card is an Ace or a face card (meaning a King, Queen or Jack of any suit). In one specific embodiment, all bets are equal in amount, including the optional insurance wager. In another specific embodiment, all bets must be equal except for the insurance bet or insurance wager. In a third embodiment, each of the bets are or may be unequal.

During play, the dealer deals a single card to each player, preferably face up. He then delivers a card to himself, again preferably face up. If the rank of the player's card is determined to beat the rank of the dealer's card, the player is paid on the first bet or first wager. Only if the player wins the first wager, and if the player has placed at least one additional bet (which at least one additional bet is preferably mandatory at the beginning of the game), does the player qualify to play an additional, consecutively played game segment. Next, the dealer deals a second card (preferably) face up to the player. He then deals himself a second card. If the rank of the player's card is determined to be higher than that of the dealer's card, the player is then paid on the second bet. The player may only advance to a second additional game segment of the game if the player placed a third bet, and the rank of the second card of the player beats the rank of the dealer's second card. Similar to the play of the first segment and the second segment, in the third round of play, player and dealer each receive a card (preferably face up), and if the player's third card rank exceeds the dealer's third card rank, the player is paid on the third wager or third bet. Although any number of sequential rounds can be played, one preferred form of play includes placing three separate wagers or bets to play three distinct game segments.

If the rank of the player and dealer cards are equal within a single segment, that segment results in a "push" and according to one embodiment, the player receives his wager back. If the "push" occurs in the first segment of the game, the player receives each of his wagers back. If the push occurs in the second segment of the game, he receives all but his first bet back. If the push occurs in the third segment of the game, he only receives his third wager back. In one example of the invention, the insurance wager or insurance bet is returned when the first round is a push. Alternatively, the insurance bet is not returned to the player when there is a push in the first segment.

If the player and the dealer both receive as a first card, an Ace or face card, the player is paid on the Ace-Face insurance bet, if an insurance wager was made. Under an alternate form of play, when the player and the dealer tie on the first bet with an Ace-face card, the player is paid 2:1 on the first bet, and the second and third bets are a push. The cards are normally regarded with respect to traditional ranking in decks, with the highest to the lowest rank going from Ace, King, Queen, Jack, 10, 9, 8, 7, 6, 5, 4, 3, and 2. In yet another embodiment, the player receives from 2:1 to 5:1 (such as 5:2, or 3:1) on the Ace-Face bet, when the dealer's card is an Ace. The insurance bet is collected or paid based on the rank of the dealer card. The rank of the player card is irrelevant to the settling this wager.

Because the higher payouts, later described in the payoffs of this game, depend on the player winning sequential rounds of play, there is more action as compared to other known forms of high/low. The game is simpler to play than poker or blackjack, for example, because the game lacks strategic decisions relating to drawing, discarding or taking hits, and is believed to have more widespread appeal. It is simple to understand because it is a variant of a high/low card game. Although the game segments are played independently, the segments are related and depend upon each other because the rules require the player to win at least one segment before advancing to the next consecutive segment.

It is also within the purview of this invention to play a lowball equivalent of the game as already described. For example, Aces may be low (or retained as high), and the game objective is for the player to receive a card lower than the dealer's card. Bonuses may be paid with an Ace and a 2–4, and 2's, 3's and 4's may be treated equivalently as the face cards were in the high card game described above. The player may be offered an option of playing a high game or a low game before any cards are dealt. This would most likely require different wagering positions or an electronic indicator to identify the election made by the player to reduce any confusion on the part of the dealer in assessing hands.

DETAILED DESCRIPTION OF THE INVENTION

This game is a variation of high/low. This game is played on a conventional gaming table and preferably uses cards delivered by an automatic shuffler, such as a batch shuffler or more preferably a continuous shuffler, such as the KING™ card shuffler, marketed by Shuffle Master, Inc. of Las Vegas, Nev. and as described in commonly owned U.S. Pat. application Ser. No. 09/060,598, filed Apr. 15, 1998 and which specification is incorporated herein by reference. The game can also be played on a computer gaming apparatus as described below.

The game can be played as a single deck game, or played with multiple standard decks of 52 cards each, including an Ace, King, Queen, Jack and 10—through two each of spades, hearts, diamonds and clubs. One or more Jokers may be included in the deck as Wild Cards or bonus cards. The game can be dealt out of a manual shoe, out of a batch shuffler or out of a continuous card shuffler such as Shuffle Master's KING™ continuous card shuffler.

Figure 1:
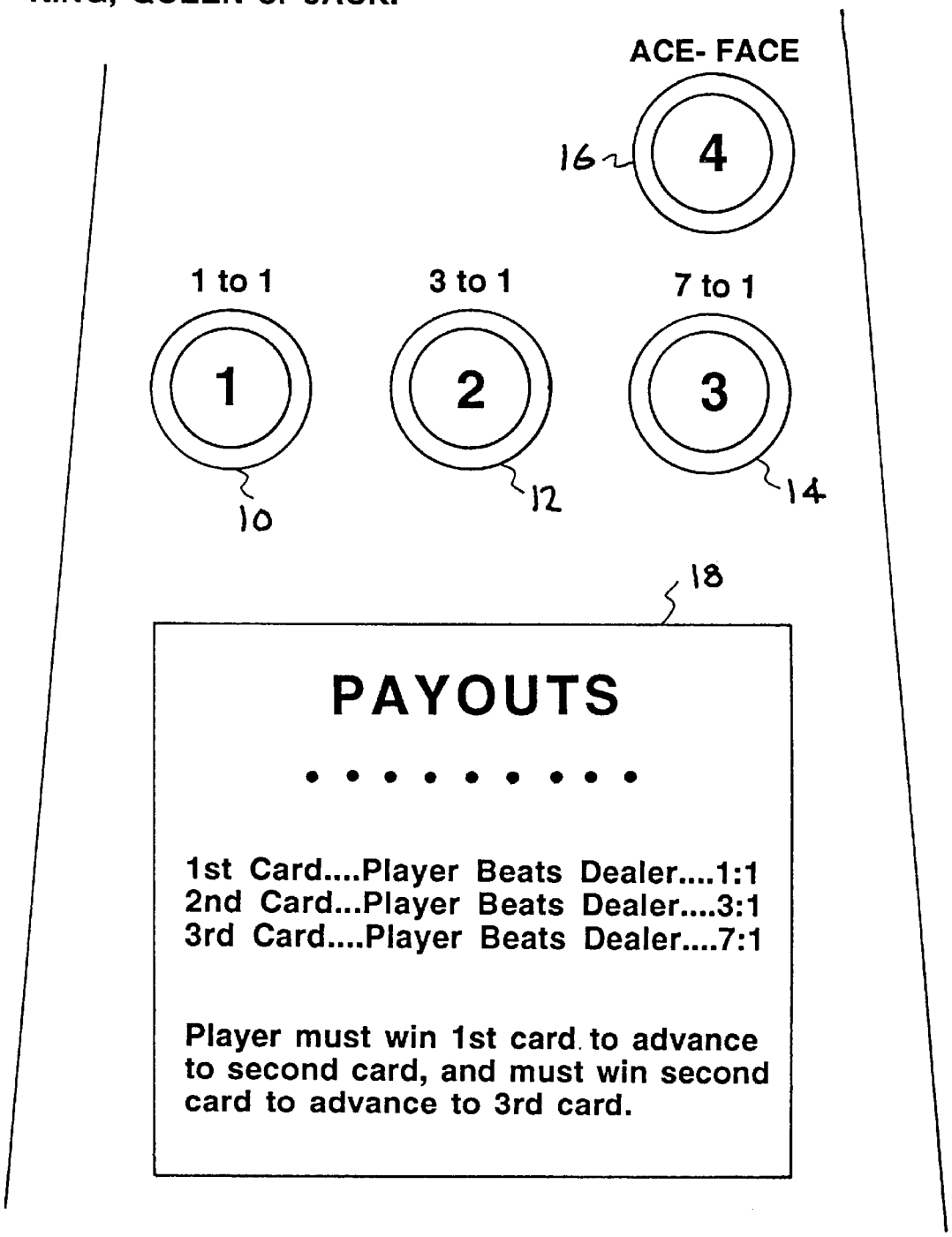
FIG. 1 shows an exemplary layout design for the present game.

A typical layout design for the present game is shown in FIG. 1. In this example of the invention, three equal bets are placed to play a three segment (or three round) game. The figure shows circular indicia 10, labeled in its center with the number 1. Above indicia 10 is a label stating: "1 to 1", which is the payout odds in one embodiment, if the first wager is resolved in favor of the player. Circular indicia 12 is labeled in its center with the number 2. Above indicia 12 is a label stating: "3 to 1", which is the payout odds, in one embodiment, if the second wager is resolved in favor of the player. Circular indicia 14 is labeled in its center with the number 3. Above indicia 14 is a label stating: "7 to 1", which is the payout odds, in one embodiment, if the third wager is resolved in favor of the player. Circular indicium 16 is labeled in its center with the number 4. Above indicia 16 is a label stating: "Ace-Face", which is the name given the optional insurance wager in embodiments described below. Also provided in the layout is an exemplary payout schedule 18. This schedule may vary according to the desires of a particular casino. As will be described in more detail below, in one example of the invention, each successive wager or bet provides a payout that exceeds payout on the previous bet. The terms "bet(s)" and "wager(s)" are used interchangeably in the practice of the present invention.

Although only one player station is shown, a layout will typically include six or seven stations, although the number of stations can vary. For example, in some high stakes rooms, a casino might choose to provide fewer player positions to provide more room for the players. The game may be played on other layouts, or on an unmarked table or other surface.

According to one method of play, the player places three equal bets on wagering areas 10, 12 and 14 as shown in FIG. 1. In another example of the invention, the bets are unequal. For example, the player might be required to bet more or less on the second and third bets than the first bet. Other betting variations are contemplated. For example, in the broadest sense, the player must make at least two consecutive bets, but it is not required to make all bets. Similarly, the game could call for four or more bets plus an optional insurance bet. The insurance wager could also be made a required wager, although this is less preferred.

The player optionally places an optional insurance bet on betting circle 16. The insurance bet is mandatory in another example of the invention. The fourth bet, also called the Ace-Face bet, provides the player with an immediate payout if the dealer's first card is an Ace or face card. For example, if the player receives a three and the dealer receives an Ace and the player has placed the Ace-Face wager, the player wins two to one on the Ace-Face bet because the dealer's card qualified as an Ace-Face hand. The player loses bets 1, 2 and 3 because the dealer's card beat the player's card, and play cannot advance to the next round unless the player wins the first bet. When the player's card is lower in rank than the dealer's card, the Ace-Face bet is an insurance-type bet. The payout on the Ace-Face wager may also be varied, depending upon the value of the dealer's card. That is, the Ace may pay 2:1 on the Ace-Face wager, while other face cards pay 1:1, or the Ace may pay 2:1, the King 3:2, and the Queen and Jack pay 1:1.

Figure 2:
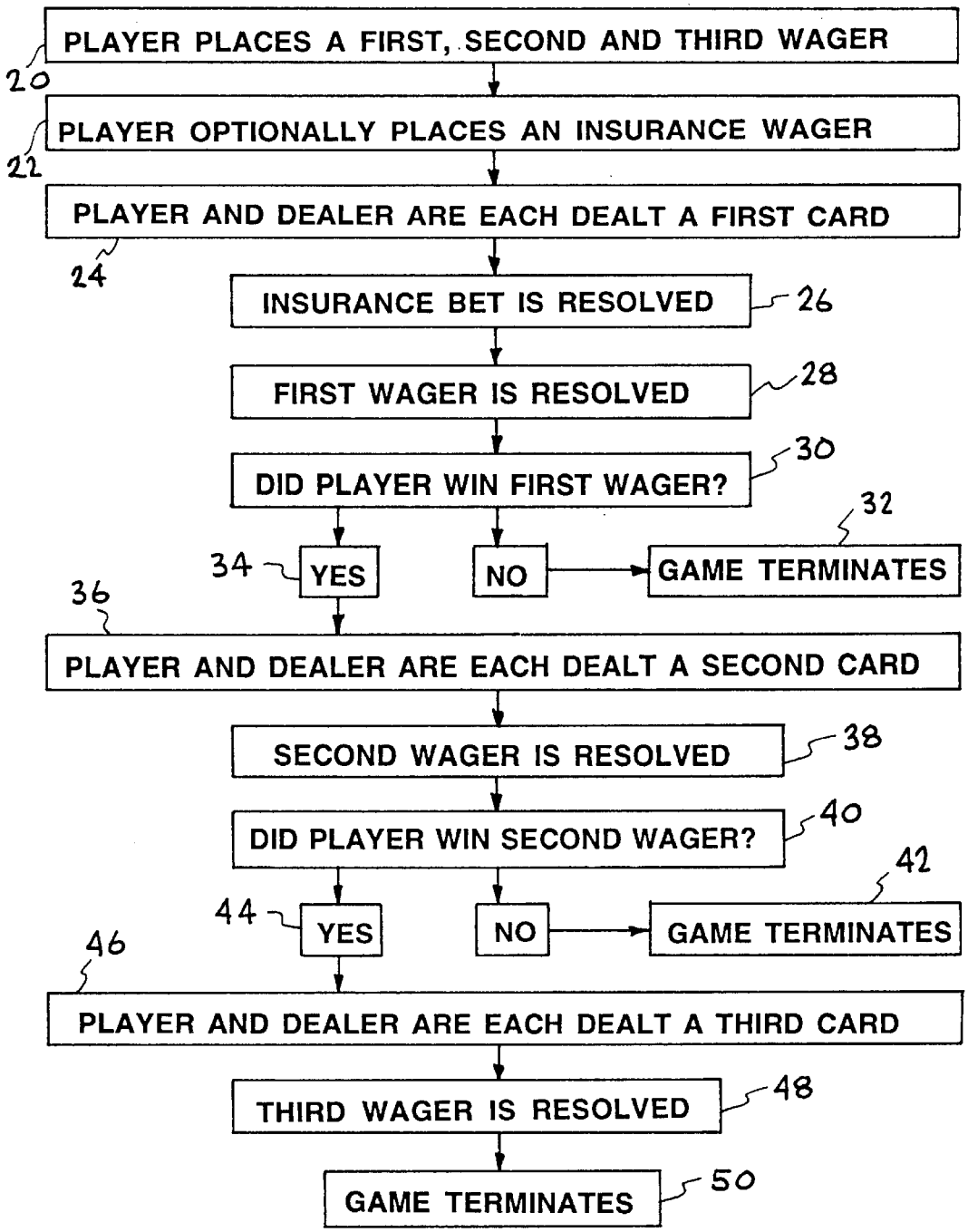
FIG. 2 is a flow chart illustrating an example of the method of present invention.

The basic game play of one example of the invention is shown in a flow chart in FIG. 2 and is described as follows. The player places a first, second and third mandatory wager (20) and an optional insurance wager (22). The dealer deals a single card from the shoe and delivers it to the player face up and then delivers a card to himself face up (24). The insurance wager, if made, is resolved (26) first. The first wager is then resolved (28). A query is made whether the player has won the first wager (30). If the answer is "no", the player loses all three wagers and the game terminates (32). If the rank of the player's card beats the rank of the dealer's card, the player is paid 1:1 on this first bet. Only if the player wins the first bet (34), does he qualify to play the second segment. The cards remain on the table but the cards previously dealt for the first segment of the game are no longer in play and are no longer relevant to the outcome of future play.

Next, the dealer deals a second card face up to the player, typically placing the card on top of the first card received by the player, which is now out of play. He then deals himself a second card placing it, for example, on top of the first card and ignoring the rank and suit of the first card as it is now out of play (36). The second wager is then resolved (38). A query is made whether the player won the second wager (40). If the answer is "no", the player loses wagers two and three and the game terminates (42). If the rank of the player's card is higher than that of the dealer's card, he is then paid 3:1 on his second bet. If there is a tie between the player and the dealer rank, the second and third wagers are returned, or the player advances to the third game segment. When two or more consecutive bets are mandatory, the house can pay higher odds on the second bet because the probability of the player winning two consecutive hands is lower than winning a single hand. For example, when the game rules require only one bet, the player can bet the first segment, the first and second segment, or bet the first, second and third segments. The player may only advance to the second and third segments of the game if the rank of his card beats the rank of the dealer's card (44), and if he placed the third bet. Similarly, in the third round of play, player and dealer each receive a card (46). The third wager is then resolved (48). If the player's card rank exceeds the dealer's card rank, he is paid 7:1 on the third bet. Once again, the house can pay greater odds on the third bet when all bets are mandatory because the probability of a player winning three consecutive hands is correspondingly lower than winning two consecutive hands. The game then terminates (50). The particular wagers and payouts described above are merely exemplary. The invention contemplates placement of unequal bets and the substitution of other payouts and odds. However, according to the first example of the invention, all bets are equal, the odds and payouts on the third bet should exceed those on the second bet, and odds and payouts on the second bet should exceed those on the first bet. In another example of the invention, all payouts are equal.

Occasionally, the player's card and the dealer's card are of equal rank. If the rank of the player and dealer cards are equal, it results in a "push" and the player receives his wager back. If the "push" occurs in the first segment of the game, the player may receive bets 1, 2 and 3 back. It is less desirable for the game to continue into subsequent game segments when there has been a push, but that is an option. The push may cause all bets to be withdrawn, allow subsequent game segments to continue in their normal play, or allow subsequent game segments to be converted to different play (e.g., the second game segment becomes a first game segment with attendant odds, and the third game segment becomes a second game segment with attendant odds). If the push occurs in the second segment of the game, the player may receive the second and third bets back. If the push occurs in the third segment of the game, the player only receives his third wager back.

Regardless of the rank of the player's card, if the dealer receives as a first card, an Ace or face card, the player is paid 2:1 on the Ace-Face insurance bet, for example. If the player's card is of higher rank than the dealer's card, and the dealer has an Ace-face card, the player wins the insurance bet and the first round of play. Under an alternate form of play, when the player wins the insurance bet and the first round of play, the player is paid 1:1 on the first bet; the second and third bets are a push.

In another embodiment, the player receives from 2:1 to 5:1 (e.g., 2:1, 5:2, 3:1, 7:3, etc.) when the dealer's card is an Ace, regardless of the player's card.

The insurance bet in one embodiment is collected or paid based on the rank of the dealer card and that the rank of the player card is irrelevant to the settling this wager. For example, a dealer Ace card might pay 3:1, a King or Queen 2:1 and a Jack 1:1. Alternatively, the dealer Ace-face card pays a fixed payout of 2:1, for example, regardless of the rank of the card (as long as it is an Ace, King, Queen or Jack).

This game was designed to eliminate the type of decision making on the part of the player that makes many poker and/or blackjack type games frustrating for a novice or more occasional recreational player. The only decision when all bets are equal and mandatory is whether or not to play the insurance bet. In other forms of the game, the player must decide which bets to make and the amount of each wager. This is a less preferred method of play, as it requires more effort on the part of the dealer in determining payouts, but is still within the scope of the invention. The game is therefore simpler to play and is believed to potentially have more widespread appeal. It is simple to understand because it is a variant of a high card game. Although the rules for resolving bets according to the invention are more complicated than with other games such as Casino War, for example, the burden is on the dealer to follow and/or apply the rules rather than the player. The Ace-Face side bet is also very similar to an insurance bet in blackjack and should be easy to understand by a blackjack player.

Although the three game segments are played independently, in the sense that cards are not carried forward from segment to segment, the segments are related and depend upon each other because the rules in one example of the invention require the player to win the present segment to advance to the next segment. The interdependence of the wagers is what allows the house to pay greater odds on subsequent segments.

A gaming machine or a conventional computer with microprocessor and memory can be programmed to execute the game play method of the present invention. According to a preferred embodiment of the invention, a gaming machine is programmed to execute the desired game play steps. Such a device either includes a conventional or special purpose computer including a microprocessor and memory. The present invention contemplates programming a computer controlled gaming machine to execute these steps so that a player can play this game individually on a gaming machine.

A preferred method of play in the practice of this invention is to have the game defined, controlled and played by a player on an electronic device, especially a software driven computer, as is used with modern casino wagering apparatuses known in the art as video wagering devices. It should be understood that manipulations within the computer are often referred to in terms such as creating, connecting, comparing, moving, displaying, determining, uploading, downloading, selecting, playing, and the like, which may be associated with manual operations performed by a human operator as well as with automatic or artificial intelligence driven functions by hardware, software, mixed hardware software functions, or other artificial intelligence systems. The operations described herein, except where manually initiated (such as button pushing, coin or currency manipulation, joy stick manipulation, light wand direction, touch screen manipulation, and the like) are machine operations performed in conjunction with various inputs provided by a human operator or user that interacts with the computer.

In addition, it should be understood that the programs, processes, methods, etc. described herein are not related or limited to any particular computer, software, operating system or apparatus, nor are they related or limited to any particular communication architecture. Rather, various types of general-purpose machines may be used with program modules constructed in accordance with the teachings described herein.

Similarly, it may prove advantageous to construct a specialized apparatus to perform the method steps described herein by way of dedicated computer systems in a specific network architecture with hard-wired logic or programs stored in nonvolatile memory, such as read only memory or on E.P.R.O.M. chips.

Additionally, the methods described herein may be practiced on a universal gaming system apparatus such as that described in co-pending U.S. patent application Ser. No. 09/405,921 filed on Sep. 24, 1999 titled "Gaming Apparatus for Wagering with Universal Computer Motherboard", which application is incorporated herein by reference for its disclosure of such architecture, apparatus, methods, harness, I/O systems, hardware and software.

An Exemplary Operating Environment

The following discussion is intended to provide a brief, general description of a suitable computing environment in which the invention may be implemented. While the invention will be described in the general context of an application program that runs on an operating system in conjunction with a personal computer, those skilled in the art will recognize that the invention may also be implemented in combination with other program modules. Generally, program modules include code, applets, routines, programs, components, objects, data structures, etc., that perform particular tasks or implement particular abstract data types. Moreover, those skilled in the art will appreciate that the invention may be practiced with other computer system configurations, including hand-held devices, multiprocessor systems, microprocessor-based or programmable consumer electronics, LAN (large area networks) networks, WAN (wide area networks), minicomputers, mainframe computers, computerized gaming machines and the like. The invention may also be practiced in distributed computing environments where tasks are performed by remote processing devices that are linked through a communication network. In a distributed computing environment, program modules may be located in both local and remote memory storage devices.

An exemplary non-limiting system for implementing the present invention includes a conventional personal computer (also referred to as a client computer), including a processor or microprocessor, a system memory, and a system bus that couples the system memory to the processor. The system memory may include read only memory (ROM) and random access memory (RAM). A basic input/output system (BIOS) is usually stored in the ROM. The BIOS essentially contains the basic routines that help to transfer information between elements within the personal computer during certain computer operations, such as during start-up. The personal computer further may include a hard disk drive, a magnetic disk drive (e.g., that reads from and writes to a removable disk), and an optical disk drive (e.g., that reads from a CD-ROM disk or reads from or writes to other optical media). The hard disk drive, magnetic disk drive, and optical disk drive may be connected to the system bus by any mechanism such as a hard disk drive interface, a magnetic disk drive interface, and/or an optical drive interface, respectively. The drives and their associated computer-readable media provide non-volatile storage for the personal computer. Although the description of computer-readable media above includes the hard disk drive, a removable magnetic disk and an optical disk, such as a CD, it should be appreciated by those skilled in the art that other types of media which are readable by a computer, such as magnetic cassettes, flash memory cards, digital video disks and tapes, Bernoulli cartridges, and the like, may also be used in the exemplary operating environment.

A number of program modules may be stored in the drives and RAM, such as an operating system and a network browsing program module. In general, the network browsing program module is a tool used to interact with other computers over data networks, such as the Internet and the World Wide Web. The network browsing program module is also a tool capable of using downloadable program modules, such as the puzzle control module, in order to direct operation of the personal computer. The drives and RAM may also store other program modules, and program data (such as image data, player input data, random number generators, comparator data (for comparing hands and comparing results with lookup tables), and other game play data).

The operating system, in conjunction with the BIOS and associated device drivers, may provide the basic interface between the computer's hardware and software resources, the user, and program modules such as the network browsing software module. A user may enter commands and information into the personal computer through a touch pad, button panel, touch screen surface, light wand surface, joy stick, and/or keyboard and an input or pointing device, such as a mouse. Other input devices (not shown) may include a microphone, a joystick, a game pad, a tracking ball, a light wand, a light gun, a satellite dish, a scanner, or the like. If the computer is part of a gaming machine, the computer may be connected to a variety of specialized peripheral devices such as a coin hopper, bill validator, monitor, player controls, ticket printer, or other device specific to gaming applications. These and other input devices are often connected to the processor through a serial port interface, such as a game port or a universal serial bus (USB). A monitor or other type of display device (e.g., public view screen, integrated monitors, serial monitors, grid monitors, and the like, with any imaging format, such as CRT, plasma screen, projection viewing, Liquid Crystal display, etc.) is also connected to the system bus via an interface, such as a video adapter. In addition to the monitor, personal computers typically include other peripheral output devices, such as printers, peripheral light displays, and speakers.

The personal computer may operate in a networked environment using logical connections to one or more remote programmable devices, such as a remote computer. The remote computer may be a server, a router, a peer device, or other common network node. Typically, the remote computer includes many or all of the elements described relative to the personal computer. In one embodiment of the present invention, the remote computer's memory storage device contains data (such as the game control module and the game data) that may be downloaded to the personal computer. The memory storage device also contains program modules (such as the game server module) that may be used by the remote computer when communicating with the personal computer. This type of format may be particularly desirable where there is related play, as among various similar devices, when associated in a bank of video gaming equipment or when there is a coordinated jackpot function, with numerous video gaming systems engaged in potential jackpot play, within one bank of computers, within one casino, within multiple casinos, or within many different gaming jurisdictions.

The logical connections may include a local area network (LAN) and a wide area network (WAN). Such networking environments are commonplace in casinos, offices, enterprise-wide computer networks, intranets and the global Internet. When used in a LAN networking environment, the personal computer is connected to the local network through a network interface. When used in a WAN networking environment, the personal computer typically includes a modem or other means for establishing communications over the wide area network, such as the global Internet. The modem, which may be internal or external, is connected to the system bus via the serial port interface. In a networked environment, program modules relative to the personal computer, or portions thereof, may be stored in the remote memory storage device. It will be appreciated that the network connections shown are exemplary and other means of establishing a communications link between the personal computer and the remote computer may be used.

As discussed earlier, one embodiment of the present invention is embodied in the game control module within the video gaming apparatus as software, hardware or a combination of software and hardware. The game control module essentially controls the previously discussed game. In one operating environment, the game control module is used in conjunction with a network browsing program module, which is supported by an available operating system. Such as Microsoft Corporation's "WINDOWS 95" or "WINDOWS NT" operating systems, LINUX, UNIX, or the like. However, it should be understood that the invention can be implemented for use with other network browsing program modules and with other operating systems and hardware, such as Microsoft Corporation's "WINDOWS 3.1" operating system, IBM Corporation's "OS/2" and "AIX" operating systems, SunSoft's "SOLARIS" operating system used in workstations manufactured by Sun Microsystem, Hewlett-Packard's "HP-UX" and "RT-UX" operating systems, and the operating system used in "MACINTOSH" computers manufactured by Apple Computer, Inc.

From this brief description, it should be appreciated that operating systems, such as the "WINDOWS 95" and "WINDOWS NT" operating system, are quite complex and provide a wide variety of services that allow users and programs to utilize the resources available in the personal computer. Those skilled in the art will be familiar with operating systems and their various features. For more comprehensive information regarding the "WINDOWS 95" and "WINDOWS NT" operating system and its interaction with programs, the reader may refer to any of a variety of publications, including the "Win32 Programmer's Reference" and "Advanced Windows", both published by Microsoft Press.

Play of the Game

Figure 3:
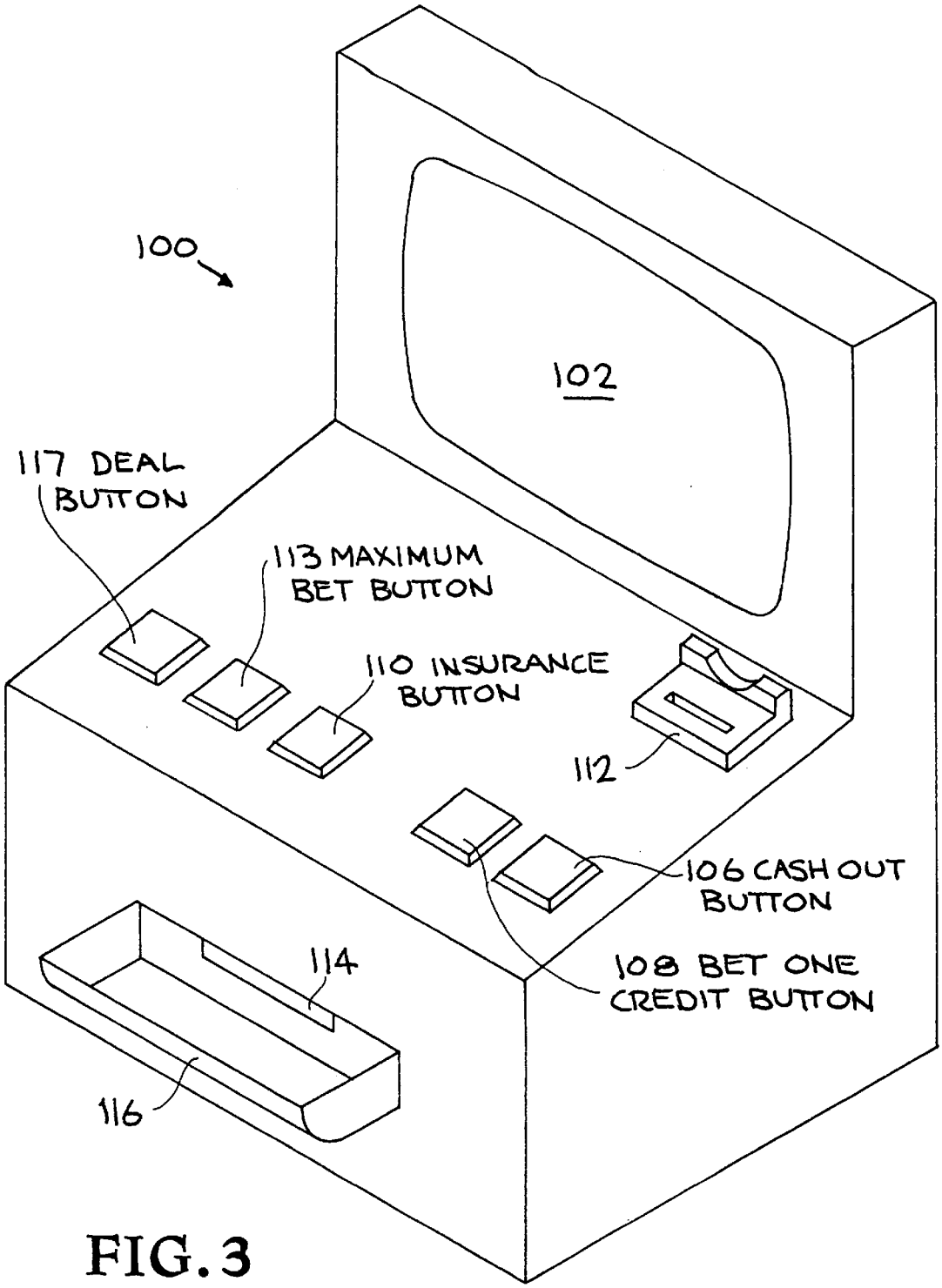
FIG. 3 is a front elevational view of a gaming machine of the present invention.

The following description, in conjunction with reference to FIG. 3, will be provided as a detailed description of the play of a single hand of the multi-part game of the invention, executed on a video gaming apparatus with hardware and software enabling the game.

A player at a video gaming apparatus 100 places a wager in the apparatus or system (by coins, currency, crediting, debiting or the like). In this example, three identical value mandatory wagers and an equal value optional insurance wager of $0.25 (twenty-five cents each) are wagered in the play of a single game. In other examples of the invention, more than or fewer than three equal or unequal wagers are placed to play a game with more than or fewer than three segments. The bets may be equal or unequal. In a preferred form of the game, the number of bets are equal to the number of game segments, excluding the insurance wager. A front elevational view of a video gaming apparatus 100 on which the game of the present invention may be readily played is shown. The apparatus 100 comprises a display panel 102 (e.g., a CRT monitor, LED display, plasma display, liquid crystal display, etc.) having operator control buttons thereon. These buttons may represent any of the operationally player controlled functions such as a cash out button 106, bet one credit button 108, insurance button 110, or maximum bet button 113. The apparatus also includes a currency or coin slot/acceptor 112, a hopper 114 and a coin-out tray 116.

Figure 4:
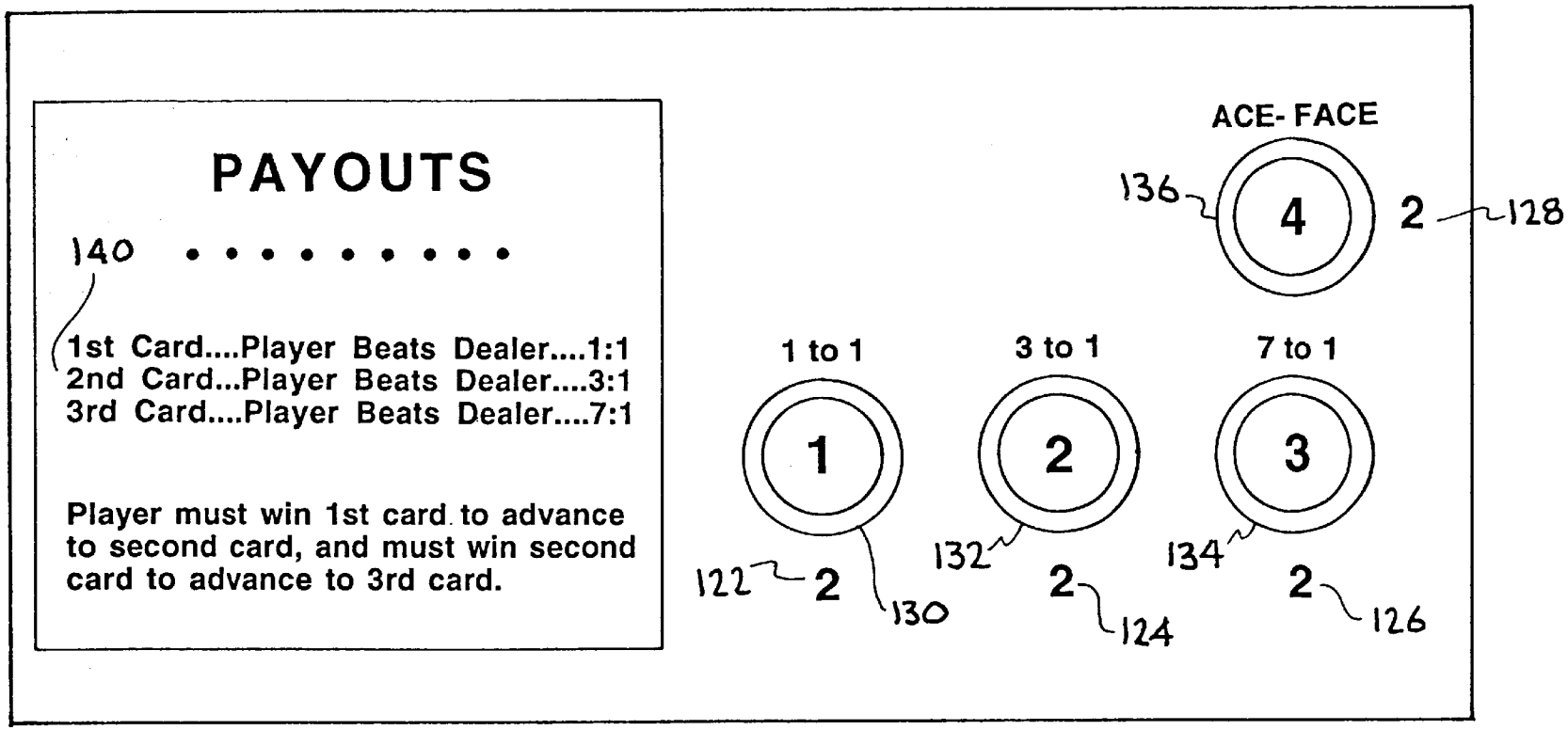
FIG. 4 is an exemplary screen display of the present invention.

Referring to FIGS. 3 and 4, a set of images displayed on display panel 102 during play of the game are illustrated. The game is begun, for example, by the player pressing maximum wager button 113 or pressing the bet one-credit button 108 the desired amount of times (three or four times). The deal button 117 is then pressed, or with the maximum bet button 113 being pressed, the deal is automatically started. Upon pressing the maximum bet button 113, (in this example the maximum bet is 2 credits) the maximum wager (of two credits each) for four bet units 122, 124, 126 and 128 is displayed for wagers 1–3 and the insurance wager. In another embodiment, the insurance wager is greater than or less than each base game wager. In yet another example of the invention, the bets are unequal, but all bets are mandatory. In another example of the invention, the player is required to place at least two sequential or consecutive bets, but not all bets. In a four segment game, for example, the player can place bets 1 and 2, 1 through 3, 1 through 4, 2 through 3, 2 through 4, and 3 through 4. An image of indicia 130, 132, 134 and 136 is displayed for wagers 1–3 and the insurance wager respectively. In other examples of the invention, the player can make two or more bets on a three segment game, but the bets must be consecutive. For example, the player can place bets 1 and 2, 2 and 3 or 1, 2 and 3.

The video gaming apparatus then displays a single card (not shown) dealt to the player face up and then displays a card dealt to the "dealer" or house face up. Cards may also be dealt face down and then flipped for enhanced table activity, in both live and video games. The insurance wager, if made, is then resolved. The first wager is then resolved. A query is made whether the player won the first wager. If the answer is "no", the player loses all three wagers and the game terminates. If the rank of the player's card beats the rank of the house card, the player is paid 1:1 on this first bet. Only if the player wins the first bet does he qualify to play the second segment. The cards remain visible but the cards previously resolved for the first segment of the game are no longer in play and are no longer relevant to the outcome of future play.

In the generally described methods of play, if the player wins the first game segment, participation in the second segment is mandatory. In another alternative example of the invention, the player can forfeit the second and third bets and then cash out. The apparatus displays a second card dealt face up to the player (not shown). The apparatus then displays a second card dealt to the "dealer" or house. The second wager is then resolved. A query is made whether the player won the second wager. If the answer is "no", the player loses wagers two and three and the game terminates. If the rank of the player's card is higher than that of the apparatuses card, the player is then paid 3:1 on his second bet. The player may only advance to the third segment of the game if the rank of his card beats the rank of the second card dealt to the apparatus. Similarly, in the third round of play, player and house each receive a third card and the third wager is then resolved. If the player's card rank exceeds the rank of the third card dealt to the apparatus, the player is paid 7:1 on the third bet. The game then terminates. Exemplary payouts are displayed on the screen at reference number 140. The particular payouts described above are merely exemplary. The invention contemplates the substitution of other payouts, such as three equal payouts, or payouts where two out of three bets pay for the same payout, or payouts that decrease over three segments, rather than increase.

Many payout or jackpot variants are also possible in the play of the game of this invention. It has become desirable and attractive for players to be provided jackpots on the occurrence of extreme events. For example, in circumstances where there are three consecutive ties, the game rules may provide for a one-to-one payout on all wagers or even a proportional payout on the collective or individual wagers. If the first four cards are identical (e.g., both the dealer and the player have specifically Aces for their cards in the first two game segments, there may be a special bonus of, for example, $5 in a $0.25 maximum wager game, or if the identical six cards are provided in the play of the first three game segments, the jackpot could be $25 in the $0.25 maximum wager game for six consecutive Aces in the player's hands and the dealer's hands). To continue after a first push, the first wager may or may not be placed at risk, with or without possibility of a positive bet resolution of the first wager. For example, the player may be trying for the multiple odds payout of the second wager or any bonus for repeated ties, risking loss without potential for reward of the first wager that resulted in a tie.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A method of playing a card game using one or more standard decks of cards, comprising:

a player placing at least two separate wagers on at least two separate segments of a multiple segment wagering game and optionally placing an insurance wager on at least a first game played with only a first card dealt to the player and only a first card dealt to a dealer;

the dealer dealing a first card to said player who has placed a first wager and a first card to said dealer;

paying said player a predetermined amount when the optional insurance wager is placed and when said first card to said dealer is an Ace or a face card; and resolving said first placed wager.

2. The method of claim 1 wherein resolving said first wager on the first game played with the first card dealt to the player and the first card dealt to the dealer requires determining if the player's first card card is respectively higher than, lower than or the same rank as the dealer's first card and resolving the wager according to game rules.

3. The method of claim 1, wherein all cards are dealt from a continuous shuffler.

4. The method of claim 1, wherein all cards are dealt face up.

5. The method of claim 1, wherein said first wager is resolved in favor of said player if the rank of said first card dealt to said player is higher than that of said first card to said dealer.

6. The method of claim 1, wherein said first wager is resolved in favor of said player if the rank of said first card to said player is higher than the rank of said first card to said dealer, wherein said player is paid 1:1 on said first wager.

7. The method of claim 1, wherein if said first card to said player and said first card to said dealer are both an Ace or face card, said player is paid in the range of 1.5:1 to 3:1 on said insurance bet.

8. The method of claim 1, wherein if said first card to said player and said first card to said dealer are both Aces or both face cards, said player is paid from 1:1 to 2:1 on said insurance bet and said first, and other wagers are a push.

9. The method of claim 1, wherein if said first card to said player and said first card to said dealer are both Aces or both face cards, and a rank of said player card exceeds a rank of said dealer card, said player is paid 1:1 on said first wager, and wherein when said second and third wagers are a push, wherein said insurance wager is paid in the range of from 1.5:1 to 3:1 to said player.

10. The method of claim 1, wherein if said first card to said player and said first card to said dealer are both Aces or face cards and said dealer's card is of a higher rank than said player's card, said player is paid a payout on said insurance wager, and all other wagers are a push.

11. The method of claim 1, wherein if said first card to said player and said first card to said dealer are both an Ace or face card and said dealer and player cards of are equal rank, said player is paid 1:1 on said first wager.

12. The method of claim 1, wherein said player receives a payout of from 2:1 to 5:1 on said insurance wager when said first card dealt to said dealer is an Ace.

13. The method of claim 1, wherein said first, second and third wagers are equal.

14. The method of claim 1, wherein said first, second and third wagers are mandatory bets.

15. The method of claim 1, wherein the step of resolving said first wager results in a push if the rank of said first card to said player and said first card to said dealer are equal.

16. The method of claim 15, wherein if said first wager is a push, said player receives said first, second and third wager back.

17. The method of claim 1 wherein if resolving the first placed wager according to game rules determines that the first placed wager is lost by the player, then all at least two separate wagers are collected by the dealer.

18. The method of claim 17 wherein the first placed wager is lost when the dealer's card is higher in rank than the player's card.

19. The method of claim 17 wherein the first placed wager is lost when the dealer's card is lower in rank than the player's card.

20. The method of claim 1, wherein if said player won said first wager, said player qualifies to receive a second card and to continue playing a second segment in said card game, the method further comprising:

said dealer dealing a second card to said player and a second card to said dealer if said player won said first wager; and resolving said second wager according to rules of a second wagering game that are different than rules of the first wager.

21. The method of claim 20, wherein said second wager must be equal to said first wager.

22. The method of claim 20, wherein said second wager is resolved in favor of said player if the rank of said second card to said player is higher than the rank of said second card to said dealer.

23. The method of claim 20, wherein said second wager is resolved in favor of said player if the rank of said second card to said player is higher than the rank of said second card to said dealer, wherein said player is paid 3:1 on said second wager.

24. The method of claim 20, wherein the step of resolving said second wager results in a push if the rank of said second card to said player and said second card to said dealer are equal.

25. The method of claim 24, wherein if said second wager is a push, said player receives said second and third wager back.

26. The apparatus of claim 25, wherein said method further comprises resolving said first wager in favor of said player if the rank of said first card to said player is higher than that of said first card to said apparatus, wherein said player is paid 1:1 on said first wager.

27. The method of claim 20, wherein if said player won said second wager and has place a third wager, said player qualifies to receive a third card and to continue playing a third segment of said card game, the method further comprising:

said dealer dealing a third card to said player and a third card to said dealer if said player won said second wager; and resolving said third wager according to rules of a third wagering game that are different than rules of the first wager and the second wager.

28. The method of claim 27, wherein said third wager must be equal to said second wager.

29. The method of claim 27, wherein said third wager is resolved in favor of said player if the rank of said third card to said player is higher than that the rank of said third card to said dealer.

30. The method of claim 27, wherein said third wager is resolved in favor of said player if the rank of said third card to said player is higher than that the rank of said third card to said dealer, wherein said player is paid in the range of 4: to 10:1 on said third wager.

31. The method of claim 27, wherein the step of resolving said third wager results in a push if the rank of said third card to said player and said third card to said dealer are equal.

32. The method of claim 31, wherein if said third wager is a push, said player receives said third wager back.

33. A method of playing a card game, comprising:

a player placing a first wager, a second wager, a third wager and having the ability to place or not to place an insurance wager on at least a first game played with the first wager on only a first card dealt to the player and on only a first card dealt to a dealer;

a dealer dealing a first card to said player and a first card to said dealer;

paying said player a predetermined amount if said first card to said dealer is an Ace or a face card if the player has placed the insurance wager; and resolving said first wager, wherein if said player has won said first wager, said player qualifies to receive a second card and continue playing a second segment of said card game, the method further comprising:

said dealer dealing a second card to said player and a second card to said dealer if said player won said first wager; and resolving said second wager, wherein if said player has won said second wager, said player qualifies to receive a third card and continue playing a third segment of said card game, the method further comprising:

said dealer dealing a third card to said player and a third card to said dealer if said player won said second wager; and resolving said third wager.

34. The method of claim 33, wherein said method further comprises requiring that said third wager must be equal to said second wager.

35. The method of claim 33, wherein the step of resolving said second wager results in a push if the rank of said second card to said player and said second card to said apparatus are equal.

36. The method of claim 35, wherein if said second wager is a push, said method further comprises the step of returning said second and third wager to said player.

37. The method of claim 33, wherein the step of resolving said third wager results in a push if the rank of said third card to said player and said third card to said dealer are equal.

38. The method of claim 37, wherein if said third wager is a push, said method further comprises returning said third wager to said player.

39. The method of claim 33, wherein said method further comprises paying said player 2:1 on said insurance bet if said first card to said player and said first card to said apparatus are both Aces or both face cards.

40. The method of claim 33, wherein if said first card to said player and said first card to said apparatus are both an Ace or face card, said method further comprises paying said player from 1.5:1 to 4:1 on said insurance bet and all other wagers are a push.

41. The method of claim 33, wherein if said first card to said player and said first card to said apparatus are both Aces or both face cards, said method further comprises paying said player from 1:1 to 2:1 on said first wager, and other wagers, except for the insurance wager are a push and said insurance wager is paid from 1.5:1 to 3:1 to said player.

42. The method of claim 33, wherein if said first card to said player and said first card to said apparatus are both Aces or both face cards, said method further comprises paying said player in the range of from 1:1 to 2:1 on said first wager, and other game segment wagers are a push.

43. The method of claim 33, wherein if said first card to said player and said first card to said apparatus are both Aces or both face card, said method further comprises paying player in the range of from 1:1 to 2:1 on said first wager.

44. The method of claim 33, wherein said method further comprises paying said player in the range of from 2:1 to 5:1 when said first card to said apparatus is an Ace.

45. The method of claim 33, wherein said first, second and third wagers are equal.

46. The method of claim 33, wherein said first, second and third wagers are mandatory bets.

47. A video gaming apparatus, comprising a microprocessor with memory, wherein said memory comprises software that includes a method of playing a game, the method comprising:

allowing a player to placing at least two wagers and an optional insurance wager on at least a first game played with only a first card dealt to the player and only a first card dealt to a dealer, wherein the at least two wagers must be consecutively played;

dealing a first virtual card to said player and a first virtual card to said apparatus;

paying said player a predetermined amount if said first virtual card to said apparatus is an Ace or a face card and when the optional insurance wager has been made; and resolving a first wager on the at least first game played with the first card dealt to the player and the first card dealt to the dealer.

48. The apparatus of claim 47, wherein said method further comprises resolving said first wager in favor of said player if the rank of said first card to said player is higher than that of said first card to said apparatus.

49. The video gaming apparatus of claim 47, wherein if said player has won said first wager, said player qualifies to receive a second virtual card and continue playing a second segment of said card game, the method further comprising:

dealing a second virtual card to said player and a second virtual card to said apparatus if said player won said first wager; and resolving a second wager.

50. The apparatus of claim 39, wherein said method further comprises requiring that said second wager must be equal to said first wager.

51. The apparatus of claim 49, wherein said method further comprises resolving said second wager in favor of said player if the rank of said second card to said player is higher than that of said second card to said apparatus.

52. The apparatus of claim 49, wherein said method further comprises resolving said second wager in favor of said player if the rank of said second card to said player is higher than that of said second card to said apparatus, wherein said player is paid 3:1 on said second wager.

53. The video gaming apparatus of claim 49, wherein if said player has won said second wager, said player qualifies to receive a third virtual card and to continue playing a third segment of said card game, the method further comprising:

dealing a third virtual card to said player and a third virtual card to said apparatus if said player won said second wager; and resolving a third wager.

54. The apparatus of claim 53, wherein said method further comprises resolving said third wager in favor of said player if the rank of said third card to said player is higher than that of said third card to said apparatus.

55. The apparatus of claim 53, wherein said method further comprises resolving said third wager in favor of said player if the rank of said third card to said player is higher than that of said third card to said apparatus, wherein said player is paid in a range from 4:1 to 10:1 on said third wager.

56. The apparatus of claim 53, wherein the step of resolving said first wager results in a push if the rank of said first card to said player and said first card to said apparatus are equal.

57. The apparatus of claim 53, wherein if said first wager is a push, said method further comprises the step of returning said first, second and third wager to said player.

58. A method of playing a card game using one or more standard decks of cards, comprising:

a player placing at least two wagers on a corresponding number of consecutively played hands of cards;

optionally placing an additional insurance wager on at least a first game played with only a first card dealt to the player and only a first card dealt to a dealer;

a dealer dealing a first card to said player and a first card to a dealer;

paying the player a payout on any additional insurance wager placed when the dealer's card is a predetermined value;

resolving a first of the at least two wagers by paying the player a first payout if a rank of the player card exceeds a rank of the dealer card, the dealer collecting the first wager if a rank of the dealer card exceeds a rank of the player card, and returning the first wager to the player if a rank of the dealer and player cards are equal; and when the player is awarded a first payout;

resolving a second of the at least two wagers by paying the player a second payout if a rank of the player card exceeds a rank of the dealer card, the dealer collecting the first wager if a rank of the dealer card exceeds a rank of the player card, and returning the second wager to the player if a rank of the dealer and player cards are equal; and when the player is not awarded a first payout, the dealer taking all remaining wagers placed on the consecutively played hands.

* * * * *